US012546099B2

(12) United States Patent
Romero et al.

(10) Patent No.: US 12,546,099 B2
(45) Date of Patent: Feb. 10, 2026

(54) SPOUT DIVERTER

(71) Applicant: ASSA ABLOY Americas Residential Inc., New Haven, CT (US)

(72) Inventors: Oscar Romero, Laguna Woods, CA (US); Haibo Cai, Xiamen (CN); Jianfei Zheng, Xiamen (CN); Paulo Pajuelo, Lake Forest, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 51 days.

(21) Appl. No.: 18/562,892

(22) PCT Filed: May 24, 2022

(86) PCT No.: PCT/US2022/030712

§ 371 (c)(1),
(2) Date: Nov. 21, 2023

(87) PCT Pub. No.: WO2022/251204

PCT Pub. Date: Dec. 1, 2022

(65) Prior Publication Data

US 2024/0368864 A1 Nov. 7, 2024

Related U.S. Application Data

(60) Provisional application No. 63/193,503, filed on May 26, 2021.

(51) Int. Cl.
*E03C 1/04* (2006.01)

(52) U.S. Cl.
CPC ..... *E03C 1/0404* (2013.01); *E03C 2201/30* (2013.01); *Y10T 137/9464* (2015.04)

(58) Field of Classification Search
CPC ..... E03C 1/0404; E03C 1/0403; E03C 2001/0416; E03C 2001/0415; E03C 1/023; E03C 2001/026; E03C 2201/30; Y10T 137/9464
USPC ..... 137/801
See application file for complete search history.

(56) References Cited

U.S. PATENT DOCUMENTS

| | | | |
|---|---|---|---|
| 2013/0134346 | A1 | 5/2013 | Huang |
| 2018/0141068 | A1 | 5/2018 | Chiu et al. |
| 2021/0140153 | A1 | 5/2021 | Yeh |

FOREIGN PATENT DOCUMENTS

| | | | |
|---|---|---|---|
| DE | 102017131230 | A1 * | 6/2019 |
| JP | 2005-288183 | A | 10/2005 |
| KR | 10-2081751 | B1 | 3/2020 |

OTHER PUBLICATIONS

DE102017131230A1—Machine translation (Year: 2017).*
International Search Report and Written Opinion for PCT/US2022/030712 mailed Sep. 8, 2022 (7 pages).

* cited by examiner

*Primary Examiner* — Daphne M Barry
(74) *Attorney, Agent, or Firm* — Merchant & Gould P.C.

(57) ABSTRACT

A spout diverter includes a diverter housing and an actuator that extends into the diverter housing. A stem is engaged by the actuator to slide longitudinally to block and divert a water flow when the actuator is pushed into the diverter housing.

17 Claims, 13 Drawing Sheets

SPOUT DIVERTER

CROSS REFERENCE TO RELATED APPLICATION

This application is a National Stage Application of PCT/US2022/030712, filed on May 24, 2022, which claims the benefit of U.S. Provisional Patent Application No. 63/193,503, filed May 26, 2021, the entire disclosures of which are incorporated herein by reference in their entireties. To the extent appropriate, a claim of priority is made to each of the above disclosed applications.

TECHNICAL FIELD

The present disclosure relates generally to tub spouts. More specifically, the present disclosure relates to diverters for tub spouts.

BACKGROUND

Tub spouts often include a diverter to divert the flow of water from the tub spout to a shower head in a shower. Generally, the diverter is positioned on the front of the tub spout and includes a handle that is pulled from a resting position to an upright position to divert the water. The handle remains in the upright position due to the pressure from the water flowing to the shower head. The handle returns to the resting position when the water flow is turned off such that water will flow through the tub spout during the next use of the shower.

Generally, the diverter is exposed to water such that calcium and other types of mineral deposits accumulate around the diverter. The accumulation of the mineral deposits can prevent the diverter from returning to the resting position after the water flow is turned off. Also, the handle of the diverter often requires placement on the front of the tub spout which limits the ability to improve the design of tub spouts. Therefore, improvements are desired.

SUMMARY

The present disclosure is generally directed to a spout diverter. In certain example embodiments, the spout diverter includes an actuator that when pushed causes a stem to slide longitudinally to block and divert water flow from a spout to another outlet. Various aspects are described in this disclosure, which include, but are not limited to, the following aspects.

In one aspect, a spout diverter comprises a diverter housing; an actuator extending into the diverter housing; and a stem engaged by the actuator to slide longitudinally to block and divert a water flow when the actuator is pushed into the diverter housing.

In another aspect, a spout diverter comprises: a diverter housing; an actuator extending into the diverter housing; and a stem engaged by the actuator to slide from a first longitudinal position to a second longitudinal position when the actuator is pushed into the diverter housing, the stem having a plunger on a rear end, the plunger configured to block a water flow from entering the diverter housing when the stem is moved by the actuator to the second longitudinal position.

DESCRIPTION OF THE FIGURES

The following drawing figures, which form a part of this application, are illustrative of the described technology and are not meant to limit the scope of the disclosure in any manner.

DETAILED DESCRIPTION

Figure 1:
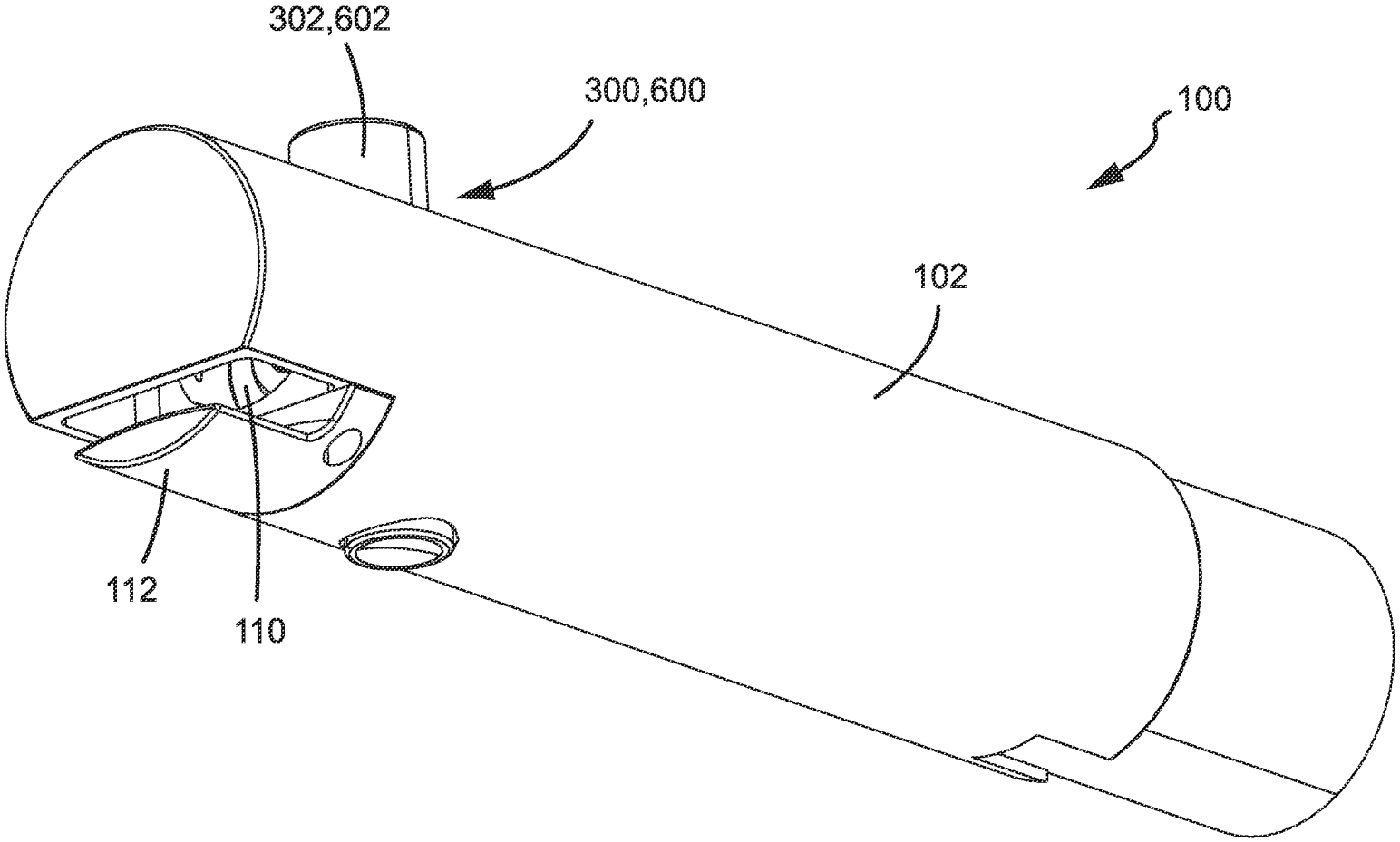
FIG. 1 is a perspective view of an example of a spout assembly according to the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

This disclosure generally relates to a spout diverter that includes an actuator that when pushed causes a stem to slide longitudinally to block and divert water flow from a spout to another outlet. Advantageously, the spout diverter is easy to operate, occupies less space, provides greater design flexibility, and prevents the buildup of mineral deposits.

FIG. 1 is a perspective view of an example of a spout assembly 100. The spout assembly 100 includes a spout diverter 300, 600 that is at least partially housed inside a spout housing 102. As will be described in more detail, first and second embodiments of the spout diverter 300, 600 can be incorporated into the spout assembly 100.

In some embodiments, the spout assembly 100 is a tub spout used for filling a bathtub with water, and the first and second embodiments of the spout diverter 300, 600 are each configured to divert water flow from the tub spout to another outlet such as a shower head.

While the spout assembly 100 is described in certain examples as directed for use in a bathtub, the first and second embodiments of the spout diverter 300, 600 can be adapted for use in additional environments such as in a sink faucet to divert the water flow from the sink faucet to another outlet such as a sprayer. Additional applications and uses for the spout diverter 300, 600 are contemplated and as such, the examples provided herein are illustrative and are not meant to limit the applicability of the spout diverter 300, 600 in any way.

Figure 2:
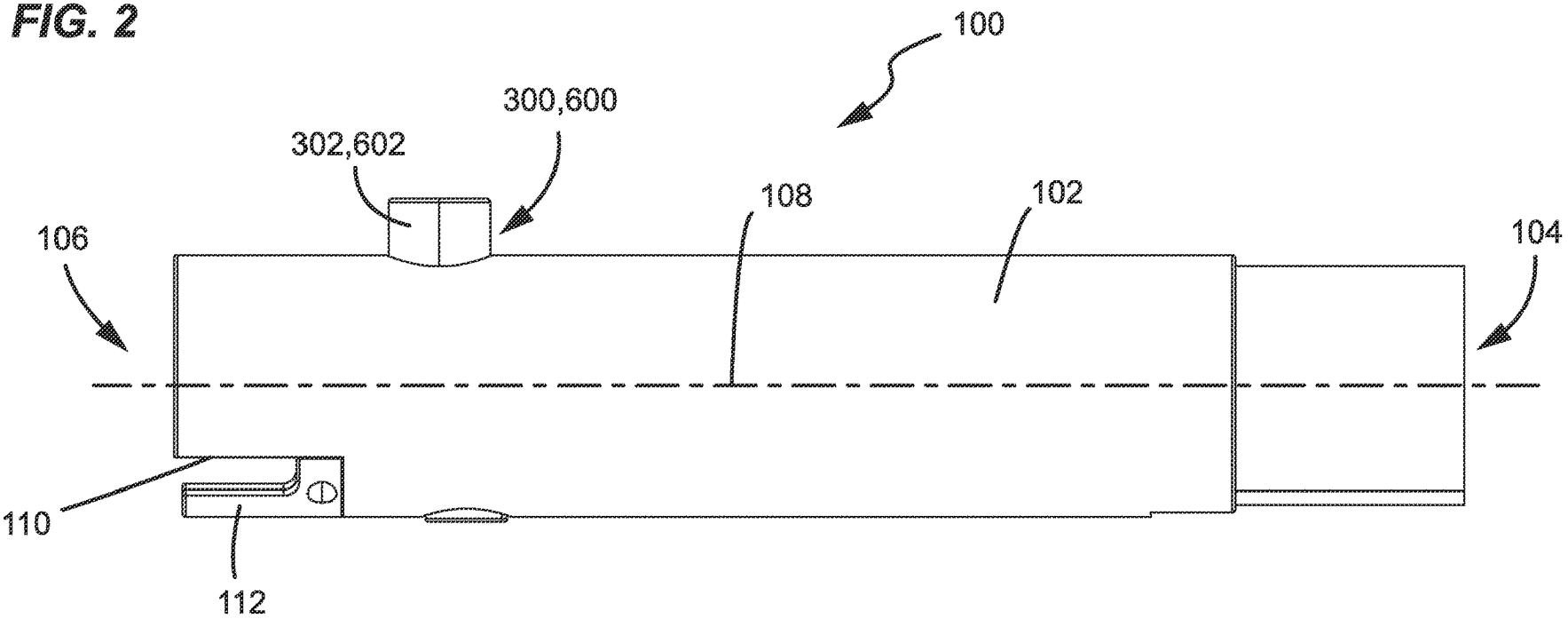
FIG. 2 is a side view of the spout assembly of FIG. 1.

FIG. 2 is a side view of the spout assembly of 100. The spout housing 102 has a proximal end 104, a distal end 106, and a central axis 108 that extends along a length of the spout housing 102 between the proximal and distal ends 104, 106. An outlet 110 is located at the distal end 106 of the spout housing 102. The spout assembly 100 is configured to receive water from a water supply that connects to the proximal end 104, and the water is configured to travel through an interior cavity of the spout housing 102, and exit from the outlet 110.

The spout housing 102 can be made from a finished metallic material such as stainless steel, chrome, brushed nickel, oil rubbed bronze, polished brass, or similar materials.

In the examples shown in the figures, the spout assembly 100 includes a flow conversion component 112 connected to the spout housing 102 to provide a cascade flow for the water after exiting from the outlet 110. In alternative embodiments, the spout assembly 100 does not include the flow conversion component 112 such that this component is optional.

The spout diverter 300, 600 includes an actuator 302, 602 that extends into the spout housing 102. The actuator 302, 602 is configured to be pushed by a user to divert the water flow from the outlet 110 to another outlet such as a shower head. Accordingly, the actuator 302, 602 acts like a push button that is ergonomically designed for user comfort and convenience. In some examples, the actuator is designed for Americans with Disabilities Act (ADA) compliance.

While the actuator 302, 602 is shown in the figures as positioned on a top portion of the spout housing 102, in alternative embodiments, the actuator 302, 602 can be positioned on a bottom portion, a left side portion, or a right side portion of the spout housing 102. Additionally, the position of the actuator 302, 602 along a length of the spout housing 102 can vary between the proximal and distal ends 104, 106. Thus, the actuator 302, 602 can be positioned farther away from the distal end 106, or can be positioned closer to the distal end 106, as may be desired.

As will be described in more detail, when the actuator 302, 602 is pushed by a user, the actuator 302, 602 causes a stem of the spout diverter 300, 600 to slide longitudinally along the central axis 108 to block and divert water flow from the spout assembly 100 to another outlet.

Figure 3:
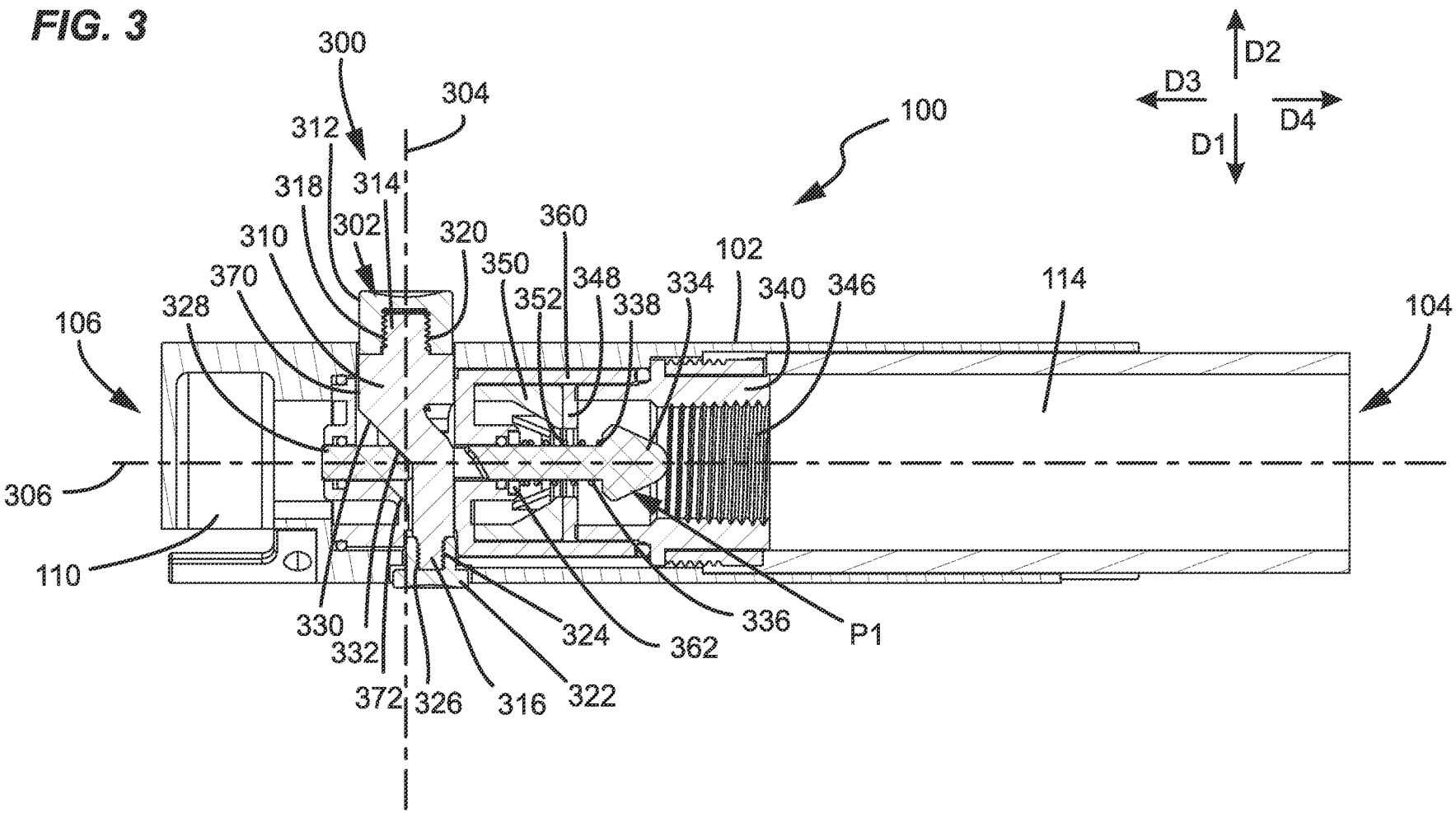
FIG. 3 is a cross-sectional side view of the spout assembly of FIG. 1 showing a first embodiment of a spout diverter, the spout diverter shown in an open position.

FIG. 3 is a cross-sectional side view of the spout assembly 100 with the spout diverter 300 shown according to the first embodiment. In FIG. 3, the spout diverter 300 is shown in an open position that allows water to flow from the proximal end 104, through an interior cavity 114, and exit the outlet 110 at the distal end 106 of the spout housing 102.

The actuator 302 can be pushed along a first axis 304, which causes a stem 328 to slide along a second axis 306 to block and divert the water flow. The second axis 306 is parallel to the central axis 108 of the spout housing 102, and is orthogonal to the first axis 304. In some examples, the first axis 304 is a vertical axis, and the second axis 306 is a horizontal axis.

The spout diverter 300 includes an adapter 340, an internal compartment 350, and a diverter housing 360. The adapter 340 is configurable to adapt the spout assembly 100 for connection to a conduit such as a copper pipe. For example, the adapter 340 is configurable to connect the spout assembly 100 with a plurality of conduits of differently sized diameters.

The adapter 340 is configured to provide a leak-free transfer of water from the conduit to the internal compartment 350. In some examples, the adapter 340 has internal threads 346 that can threadedly engage corresponding external threads on the conduit to connect the spout assembly 100 to the conduit and receive a water flow.

The internal compartment 350 includes an opening 352 that can receive the water flow from the adapter 340 when the spout diverter 300 is in an open position. In some examples, a washer 348 is positioned between the adapter 340 and the internal compartment 350. The washer 348 has an aperture that is aligned with the opening 352 such that the water flow can pass through the washer 348 and into the internal compartment 350. The washer 348 can improve the leak-free transfer of water flow from the conduit to the internal compartment 350.

As shown in FIG. 3, the internal compartment 350 is contained inside the diverter housing 360. As will be described in more detail, the water flow can pass through the diverter housing 360 to exit the outlet 110 on the distal end 106 of the spout housing 102.

As further shown in FIG. 3, the actuator 302 extends into the diverter housing 360. The actuator 302 includes a shaft 310, and a push button 312 attached to a proximal end 314 of the shaft 310. A push button 312 is configured to be pushed by a user to move the shaft 310 inside the diverter housing 360 in a first direction D1 along the first axis 304.

In some examples, the push button 312 is made from a finished metallic material such as stainless steel, chrome, brushed nickel, oil rubbed bronze, polished brass, or similar materials. In further examples, the push button 312 is made from molded plastic, rubber, or otherwise has a rubberized surface for providing a non-slip surface and improved grip for the user, which can further enhance the ergonomic design of the spout diverter 300.

In the example shown in FIG. 3, the push button 312 has internal threads 318 that threadedly engage external threads 320 on a proximal end 314 of the shaft 310 for attaching the push button 312 to the shaft 310. In alternative examples, the push button 312 can attach to the proximal end 314 of the shaft 310 by other structural means such as by a snap-fit connection. In some further examples, the actuator 302 does not include a push button that separately attaches to a shaft, and instead the actuator 302 is a single, integral component that can be molded or otherwise shaped to have the characteristics of the shaft 310 and push button 312.

Still referring to FIG. 3, a cap 322 is attached to a distal end 316 of the shaft 310. In the example shown in FIG. 3, the cap 322 has internal threads 324 that threadedly engage external threads 326 on a distal end 316 of the shaft 310 for attaching the cap 322 to the shaft 310. In alternative examples, the cap 322 can attach to the distal end 316 of the shaft 310 by other structural means such as by a snap-fit connection. In yet further examples, the spout diverter 300 does not include the cap 322 such that the cap 322 is an optional component.

The shaft 310 has a slanted surface 330 that is positioned between the proximal end 314 and the distal end 316. As shown in FIG. 3, the slanted surface 330 engages a corresponding slanted surface 332 on the stem 328 of the spout diverter 300. In the first embodiment of the spout diverter 300 shown in FIGS. 3 and 4, the stem 328 includes a plunger 334 positioned on a rear end of the stem 328 (i.e., towards the proximal end 104 of the spout housing 102).

Figure 4:
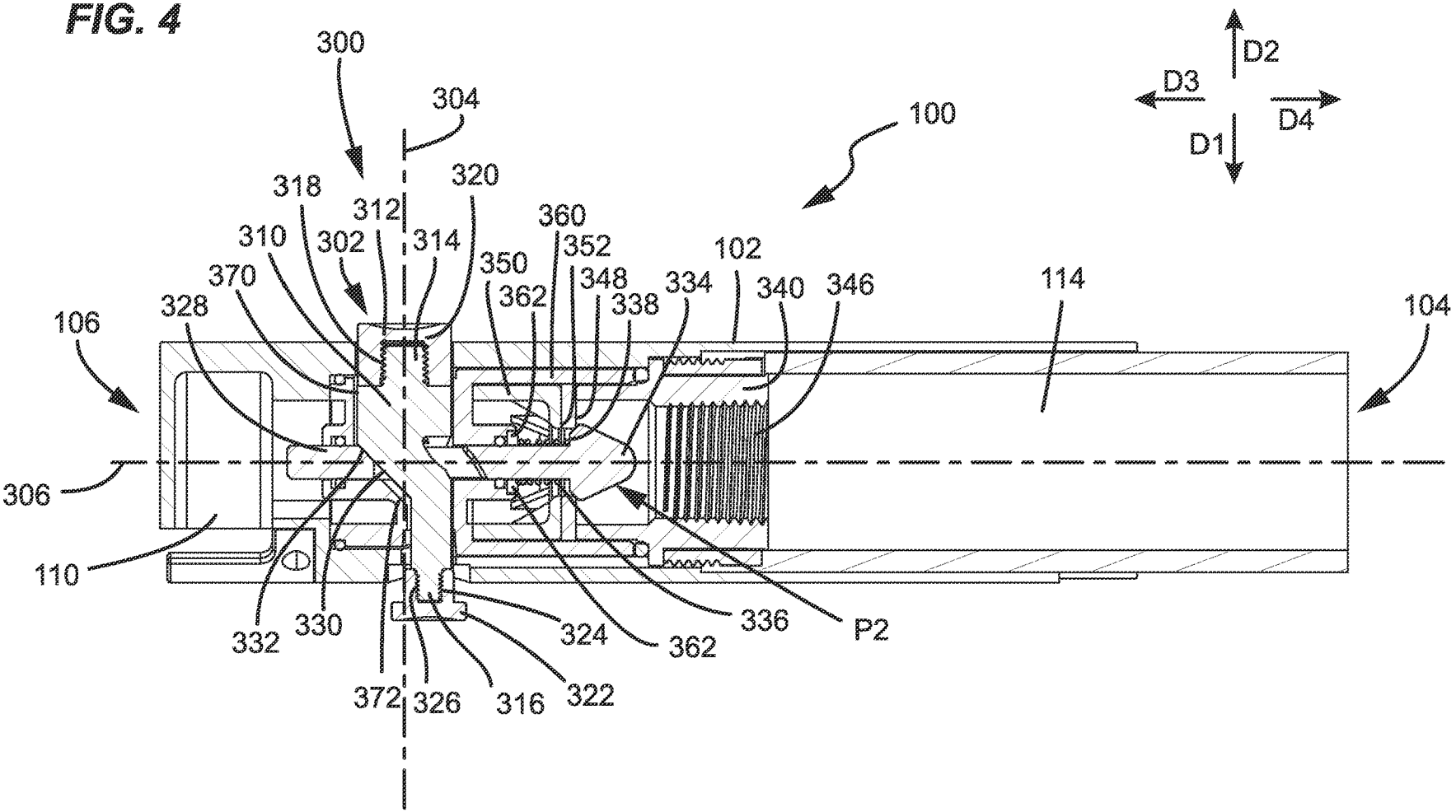
FIG. 4 is another cross-sectional side view of the spout assembly of FIG. 1 showing the first embodiment of the spout diverter in a closed position.

FIG. 4 is a cross-sectional side view of the spout assembly 100 with the spout diverter 300 of the first embodiment shown in a closed position. Referring now to FIGS. 3 and 4, when a user pushes the push button 312 in the first direction D1 along the first axis 304, the spout diverter 300 moves from the open position (FIG. 3) to the closed position (FIG. 4).

For example, when the push button 312 is pushed in the first direction D1 along the first axis 304, the slanted surface 330 of the shaft 310 engages the corresponding slanted surface 332 on the stem 328, which causes the stem 328 to longitudinally slide along the second axis 306 in a third direction D3. The stem 328 longitudinally slides through the diverter housing 360 along the second axis 306 which is parallel to a length of the diverter housing 360. Thus, pushing the push button 312 in the first direction D1 causes the stem 328 to longitudinally slide in the third direction D3. As shown in FIGS. 3 and 4, the third direction D3 is orthogonal to the first direction D1, and is directed toward the distal end 106 of the spout housing 102.

In FIG. 3, the stem 328 is shown in a first longitudinal position P1. When in the first longitudinal position P1, the water flow is able to flow past the plunger 334 and enter through the opening 352 of the internal compartment 350. Thereafter, the water flow can flow through the diverter housing 360 to exit the outlet 110 on the distal end 106 of the spout housing 102.

Figure 5:
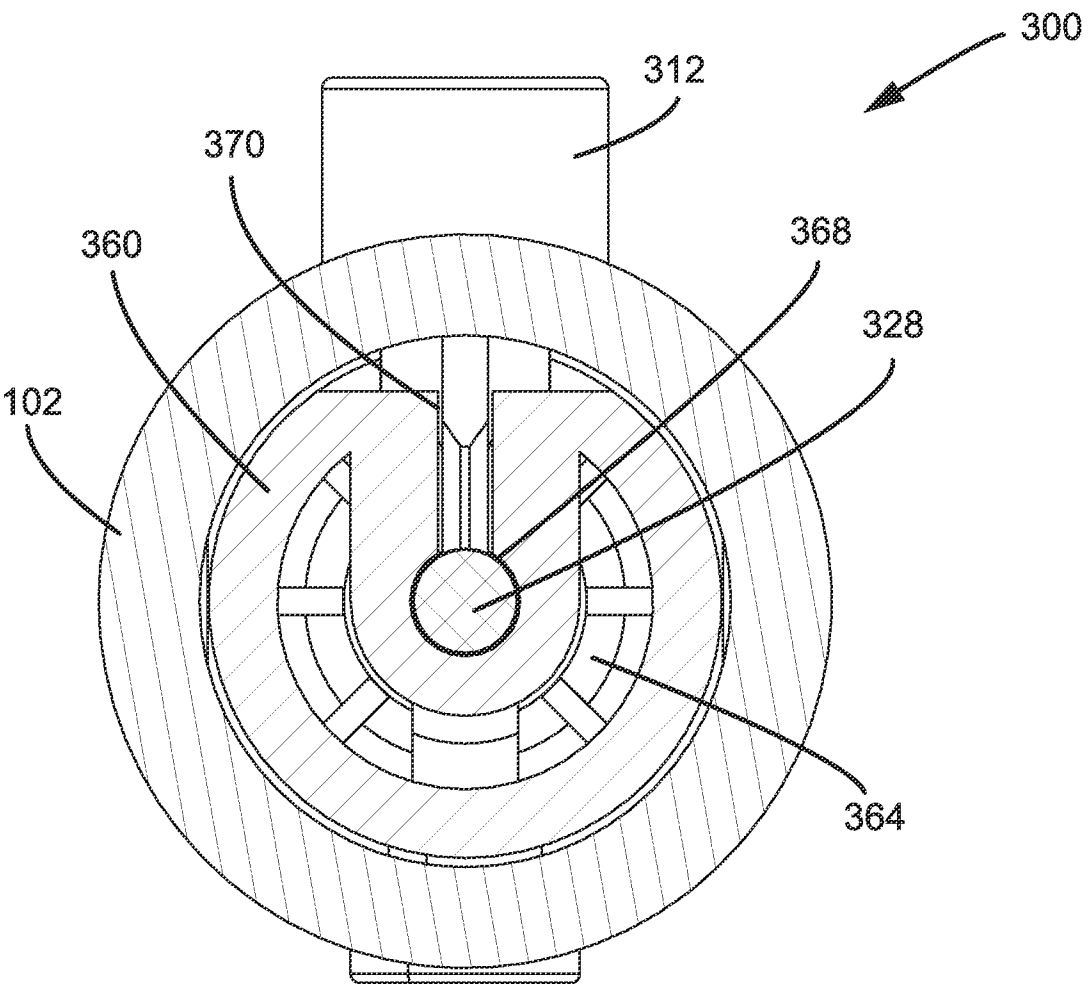
FIG. 5 is a cross-sectional front view of the spout assembly of FIG. 1 showing the first embodiment of the spout diverter.

FIG. 5 is a cross-sectional front view of the spout assembly 100 showing the first embodiment of the spout diverter 300. Referring now to FIGS. 3-5, the diverter housing 360 defines a passageway 364 that allows the water flow to flow through the diverter housing 360.

Additionally, the diverter housing 360 defines a bore 368 through which the stem 328 longitudinally slides, and a channel 370 in which the shaft 310 is able to move along the first axis 304. As shown in FIGS. 3 and 4, the channel 370 can include a stop 372 that prevents the actuator 302 from being pushed beyond a predefined distance along the first axis 304.

Advantageously, the diverter housing 360 shields the actuator 302 from the water flow that flows through the passageway 364. This can prevent the build up of mineral deposits around the shaft 310, and improve the durability of the spout diverter 300.

In FIG. 4, the stem 328 is shown in a second longitudinal position P2. When in the second longitudinal position P2, the plunger 334 seals the opening 352 of the internal compartment 350, and thereby blocks the water flow from entering into the internal compartment 350. The pressure of the water flow that is supplied from the conduit causes the water flow to be diverted away from the spout assembly 100, and to flow to another outlet such as a shower head.

In the example shown in FIG. 4, the distal end 316 of the shaft 310 is shown as extending beyond a bottom portion of the spout housing 102. In alternative examples, the distal end 316 of the shaft 310 does not extend beyond the bottom portion of the spout housing 102 such that the distal end 316 of the shaft 310 is contained inside the spout housing 102.

In the example shown in FIGS. 3 and 4, the washer 348 is positioned between the adapter 340 and the internal compartment 350. As described above, the washer 348 has an aperture aligned with the opening 352 of the internal compartment 350 such that the water flow can flow through the washer 348 and into the internal compartment 350. In some examples, the washer 348 is made from a rubber or flexible plastic material. The plunger 334 engages the washer 348 to seal the opening 352 when the stem 328 is moved into the second longitudinal position P2. The washer 348 can improve the sealing of the opening 352 by the plunger 334.

Advantageously, the plunger 334 prevents water from entering into the internal compartment 350 and diverter housing 360 when the spout diverter 300 is in the closed position. This can reduce the buildup of mineral deposits inside the internal compartment 350 and the diverter housing 360, and can improve the durability of the spout assembly 100.

A spring 336 is positioned around the stem 328. One end of the spring 336 engages a lip 338 of the plunger 334, and an opposite end of the spring 336 engages the diverter housing 360. In some examples, a washer 362 is included on the diverter housing 360 such that the spring 336 is positioned around the stem 328 between the washer 362 and lip 338 of the plunger.

When the push button 312 is pushed in the first direction D1 along the first axis 304 such that the stem 328 longitudinally slides from the first longitudinal position P1 to the second longitudinal position P2, the spring 336 is compressed. The spring 336 has a spring force that is less than or equal to the pressure from the water flow exerted on the plunger 334. This causes the spring 336 to remain compressed while the water flow remains turned on, and after the user lets go of the push button 312. The pressure from the water flow acts on the plunger 334 to keep the stem 328 in the second longitudinal position P2, and thereby keeps the spout diverter 300 in the closed position while the water flow remains turned on.

When the water flow from the water supply is turned off, water pressure is no longer exerted on the plunger 334. The spring force of the spring 336 causes the spring 336 to expand, and causes the stem 328 to move in a fourth direction D4 along the second axis 306. The fourth direction D4 is an opposite, reverse direction of the third direction D3. The spring force of the spring 336 causes the stem 328 to move from the second longitudinal position P2 to the first longitudinal position P1 such that the plunger 334 no longer blocks the opening 352 of the internal compartment 350, and the spout diverter 300 moves into the open position.

When the stem 328 moves in the fourth direction D4 along the second axis 306, the corresponding slanted surface 332 on the stem 328 engages the slanted surface 330 of the shaft 310. This causes the shaft 310 and the push button 312 to move in a second direction D2 along the first axis 304. The second direction D2 is an opposite, reverse direction of the first direction D1, and is orthogonal to the third and fourth directions D3, D4. Thus, when the water flow is turned off, the spring 336 automatically returns the spout diverter 300 to the open position.

When the water flow is turned back on during a subsequent use of the spout assembly 100, the spout diverter 300 will be in the open position, Thus, the water flow will flow out of the outlet 110. In order to divert the water from the outlet 110, the user will need to turn on the water supply and push the push button 312 in the first direction D1 to divert the water.

Figure 6:
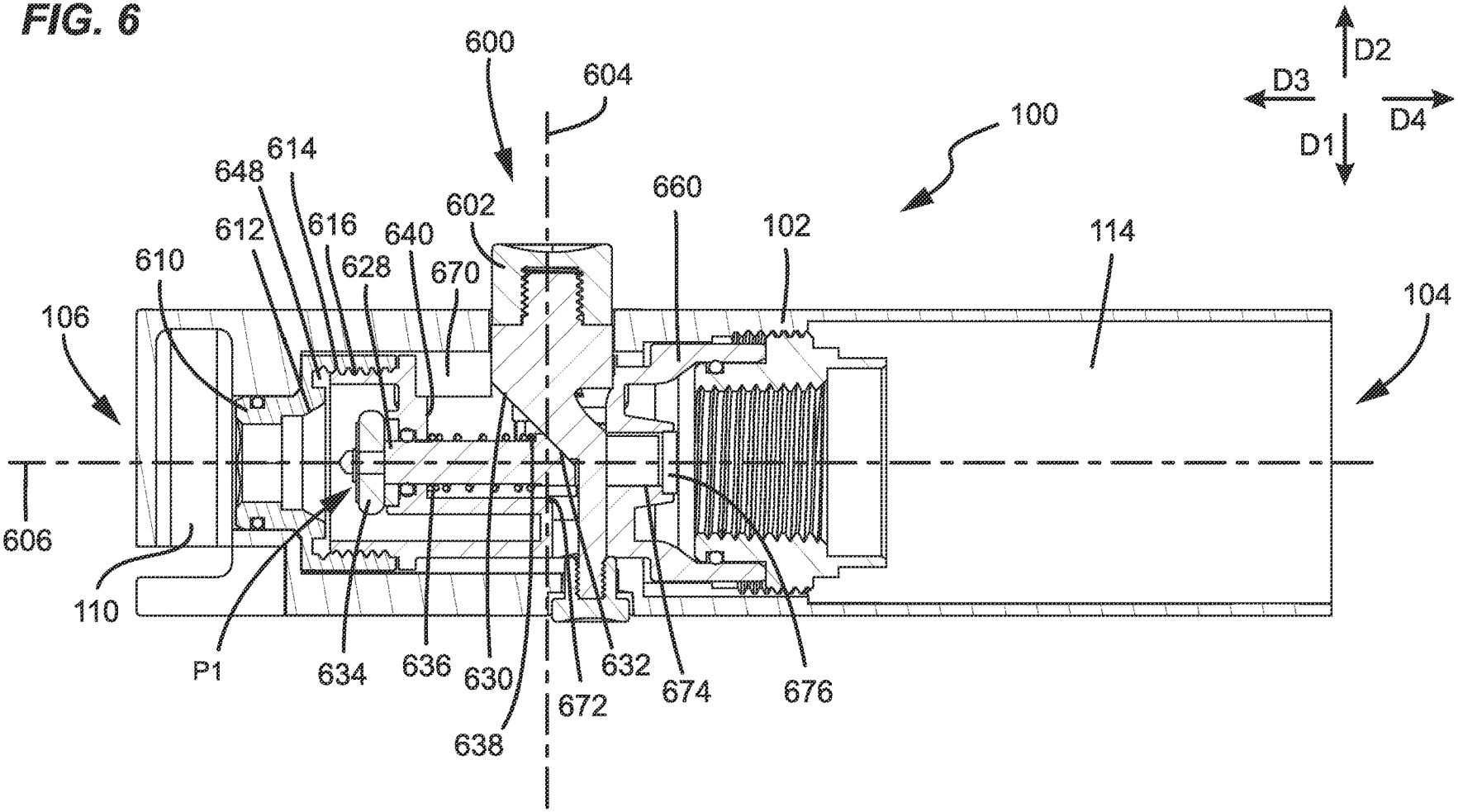
FIG. 6 is a cross-sectional side view of the spout assembly of FIG. 1 showing a second embodiment of a spout diverter, the spout diverter shown in an open position.
Figure 7:
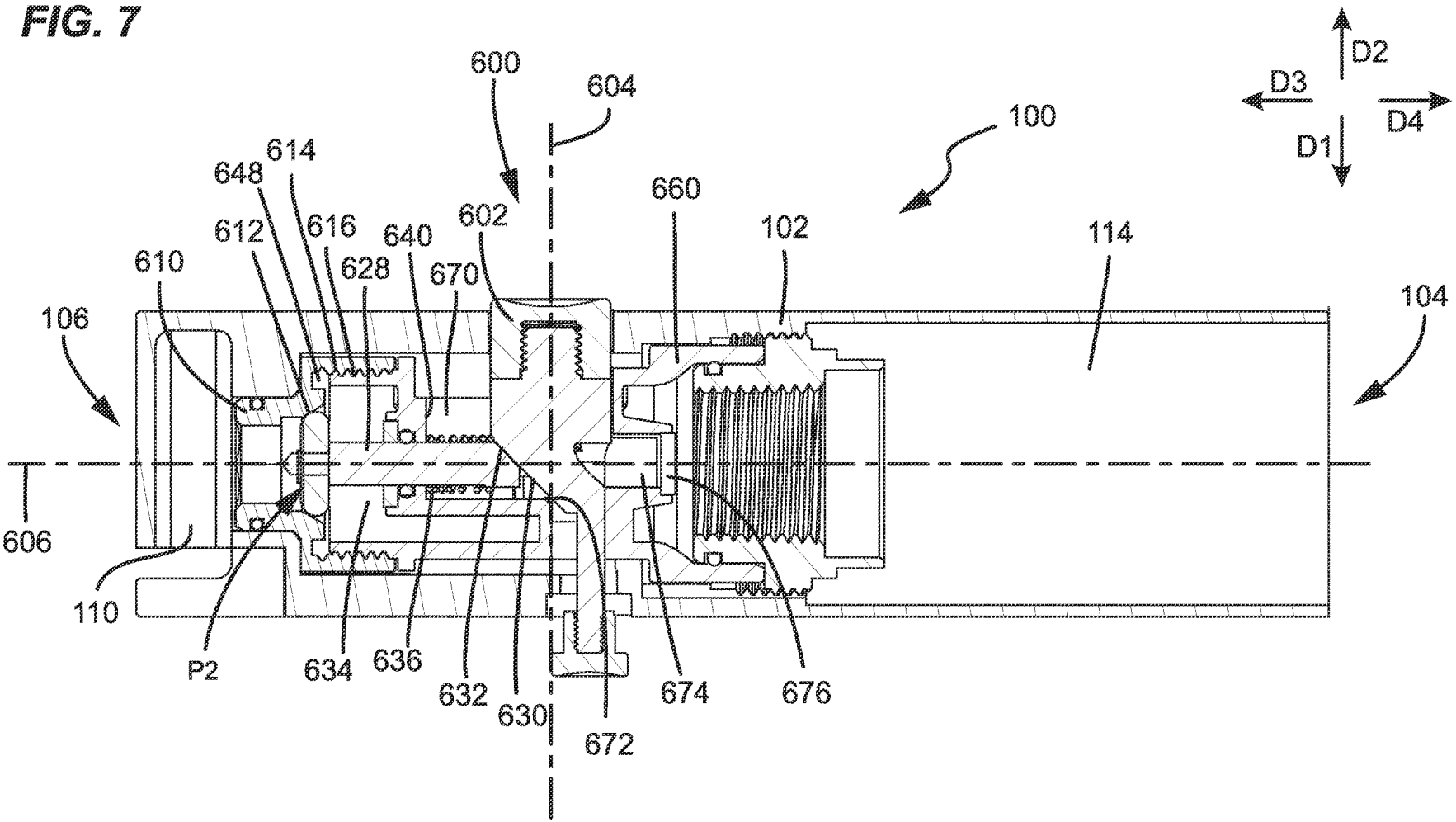
FIG. 7 is another cross-sectional side view of the spout assembly of FIG. 1 showing the second embodiment of the spout diverter in a closed position.
Figure 8:
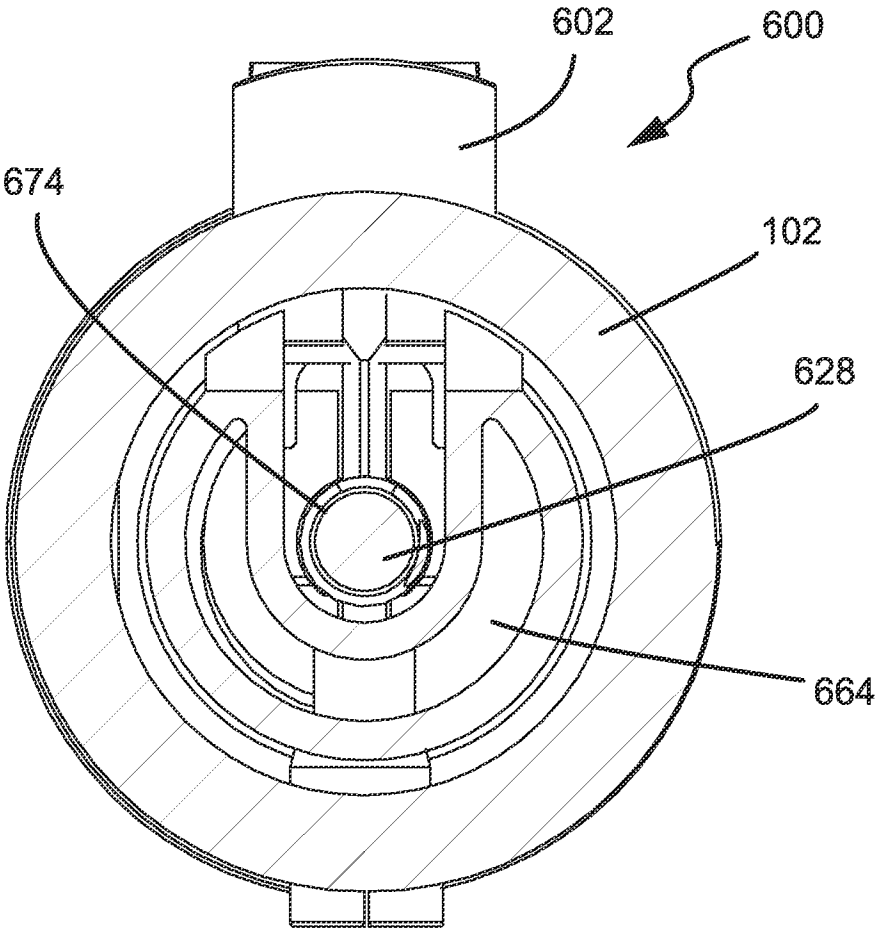
FIG. 8 is a cross-sectional front view of the spout assembly of FIG. 1 showing the second embodiment of the spout diverter.

FIG. 6 is a cross-sectional side view of the spout assembly 100 showing a second embodiment of a spout diverter 600 in an open position. FIG. 7 is another cross-sectional side view of the spout assembly 100 showing the spout diverter 600 in a closed position. FIG. 8 is a cross-sectional front view of the spout assembly 100 showing the spout diverter 600. The spout diverter 600 can share similar components with the spout diverter 300.

The spout diverter 600 includes an actuator 602 that extends into a diverter housing 660, and that can be pushed in the first direction D1 along a first axis 604, which causes a stem 628 to slide longitudinally along a second axis 606 to block and divert the water flow. In the example shown in FIGS. 6-8, the actuator 602 has a push button attached to a shaft similar to the actuator 302 in the first embodiment of the spout diverter 300 shown in FIGS. 3 and 4. Alternatively, the actuator 602 can be a single, integral component that can be molded or otherwise shaped to have the characteristics of the shaft and push button.

The second embodiment of the spout diverter 600 differs from the first embodiment in that the stem 628 has a plunger 634 positioned on a front end of the stem 628 (i.e., towards the distal end 106 of the spout housing 102). When a user pushes the actuator 602 in the first direction D1 along the first axis 604, a slanted surface 630 of the actuator 602 engages a corresponding slanted surface 632 on the stem 628, which causes the stem 628 to longitudinally slide along the second axis 606 in the third direction D3. Thus, pushing the actuator 602 causes the plunger 634 to seal an opening 612 of an end cap 610 attached to a distal end of the diverter housing 660, and to thereby block the water flow from exiting the diverter housing 660.

The plunger 634 is shaped to match the opening 612 of the end cap 610. In some examples, the plunger 634 is donut shaped. The plunger 634 can be made from a rubber or plastic material to provide a tight seal between the plunger 634 and the opening 612.

In the example shown in FIGS. 6 and 7, the end cap 610 has internal threads 614 that threadedly engage external threads 616 of the diverter housing 660 for attaching the end cap 610 to the diverter housing 660. Alternative structural means may be used to attach the end cap 610 to the diverter housing 660. In some examples, a washer 648 is positioned between the diverter housing 660 and the end cap 610 to improve the seal between the diverter housing 660 and the end cap 610. In some further examples, the end cap 610 is integral with the diverter housing 660 such that the end cap 610 and diverter housing 660 are not separate parts that attach together.

In FIG. 6, the stem 628 is shown in a first longitudinal position P1. When in the first longitudinal position P1, the water flow is able to flow past the plunger 634 and flow through the opening 612 of the end cap 610. Thereafter, the water flow can exit the outlet 110.

In FIG. 7, the stem 628 is shown in a second longitudinal position P2. When in the second longitudinal position P2, the plunger 634 seals the opening 612 of the end cap 610, and blocks the water flow from flowing out of the diverter housing 660 and exiting the outlet 110. The pressure of the water flow that is supplied from the conduit causes the water flow to be diverted away from the spout assembly 100, and to flow to another outlet.

In the example shown in FIG. 7, a distal end of the actuator 602 is shown as extending beyond the bottom portion of the spout housing 102. In alternative examples, the distal end of the actuator 602 does not extend beyond the bottom portion of the spout housing 102.

A spring 636 is positioned around the stem 628. One end of the spring 636 engages a flange 638 on the stem 628, and an opposite end of the spring 636 engages a wall 640 inside an interior portion 670 of the diverter housing 660. When the actuator 602 is pushed in the first direction D1 along the first axis 604 such that the stem 628 longitudinally slides from the first longitudinal position P1 to the second longitudinal position P2, the spring 636 is compressed inside the interior portion 670 of the diverter housing 660.

The spring 636 has a spring force that is less than or equal to the pressure from the water flow that flows through the diverter housing 660 and is exerted on the plunger 634. This causes the spring 636 to remain compressed while the water flow remains turned on, and after the user lets go of the actuator 602. The pressure from the water flow acts on the plunger 634 to keep the stem 628 in the second longitudinal position P2, and thereby keeps the spout diverter 600 in the closed position while the water flow remains turned on.

When the water flow from the water supply is turned off, water pressure is no longer exerted on the plunger 634. The spring force of the spring 636 causes the spring 636 to expand, which causes the stem 628 to move in the fourth direction D4 along the second axis 606. Thus, the spring force of the spring 636 causes the stem 628 to return to the first longitudinal position P1 such that the plunger 634 no longer blocks the opening 612 of the end cap 610.

When the stem 628 moves in the fourth direction D4 along the second axis 606, the corresponding slanted surface 632 on the stem 628 engages the slanted surface 630 of the actuator 602. This causes the actuator 602 to move in the second direction D2 along the first axis 604. Thus, when the water flow is turned off, the spring 636 automatically returns the spout diverter 600 to the open position. When the water flow is turned back on during a subsequent use of the spout assembly 100, the spout diverter 600 will be in the open position and the water flow will flow out of the outlet 110. In order to divert the water from the outlet 110, the user will need to turn on the water supply and push the actuator 602 in the first direction D1 to divert the water.

As shown in FIG. 8, the diverter housing 660 defines a passageway 664 that allows the water flow to flow through the diverter housing 660. As shown in FIGS. 6-8, the diverter housing 660 further defines the interior portion 670 which houses the actuator 602 and the spring 636. The interior portion 670 can include a stop 672 that prevents the actuator 602 from being pushed beyond a predefined distance along the first axis 604.

Advantageously, the interior portion 670 shields the actuator 602 and the spring 636 from the water flow that flows through the passageway 664 of the diverter housing 660. This can reduce the buildup of mineral deposits around the actuator 602 and the spring 636 (which can interfere with their operation), and can thus improve the durability of the spout diverter 600.

Additionally, the stem 628 longitudinally slides inside a bore 674 that is closed off by a portion 676 of the diverter housing 660. This shields a proximal end of the stem 628 from the water flow whether the spout diverter 600 is in the open or closed position. Also, a distal end of the stem 628 is housed inside the bore 674 when the spout diverter 600 is in the open position such that the distal end of the stem 628 is shielded from the water flow when the spout diverter is in the open position which can further reduce the buildup of calcium and other types of mineral deposits around the stem 628, and can thus improve the durability of the spout diverter 600.

Figure 9:
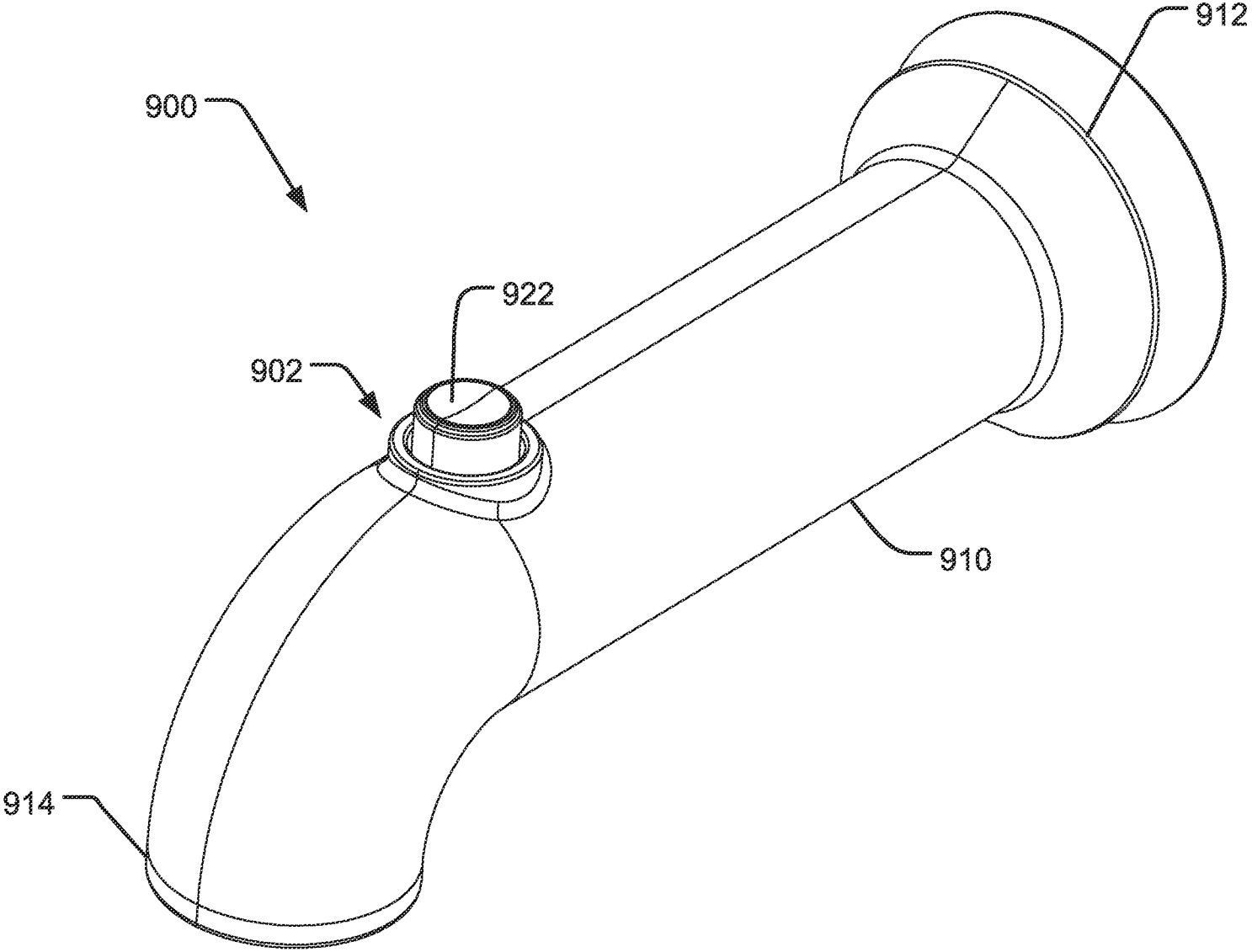
FIG. 9 is a perspective view of another example of a spout assembly according to the present disclosure.
Figure 10:
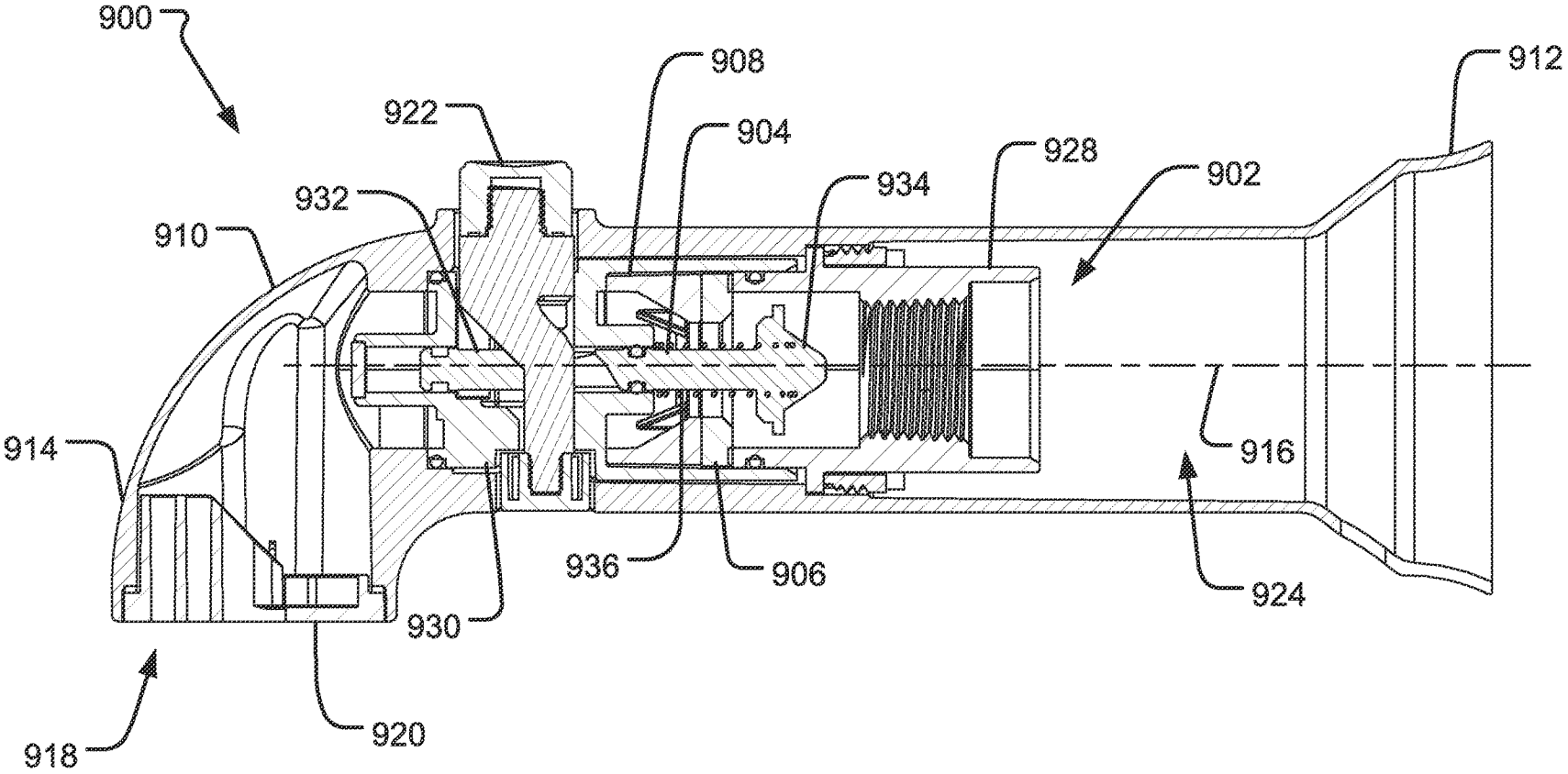
FIG. 10 is a cross-sectional side view of the spout assembly of FIG. 9 showing a third embodiment of a spout diverter, the spout diverter shown in an open position.
Figure 11:
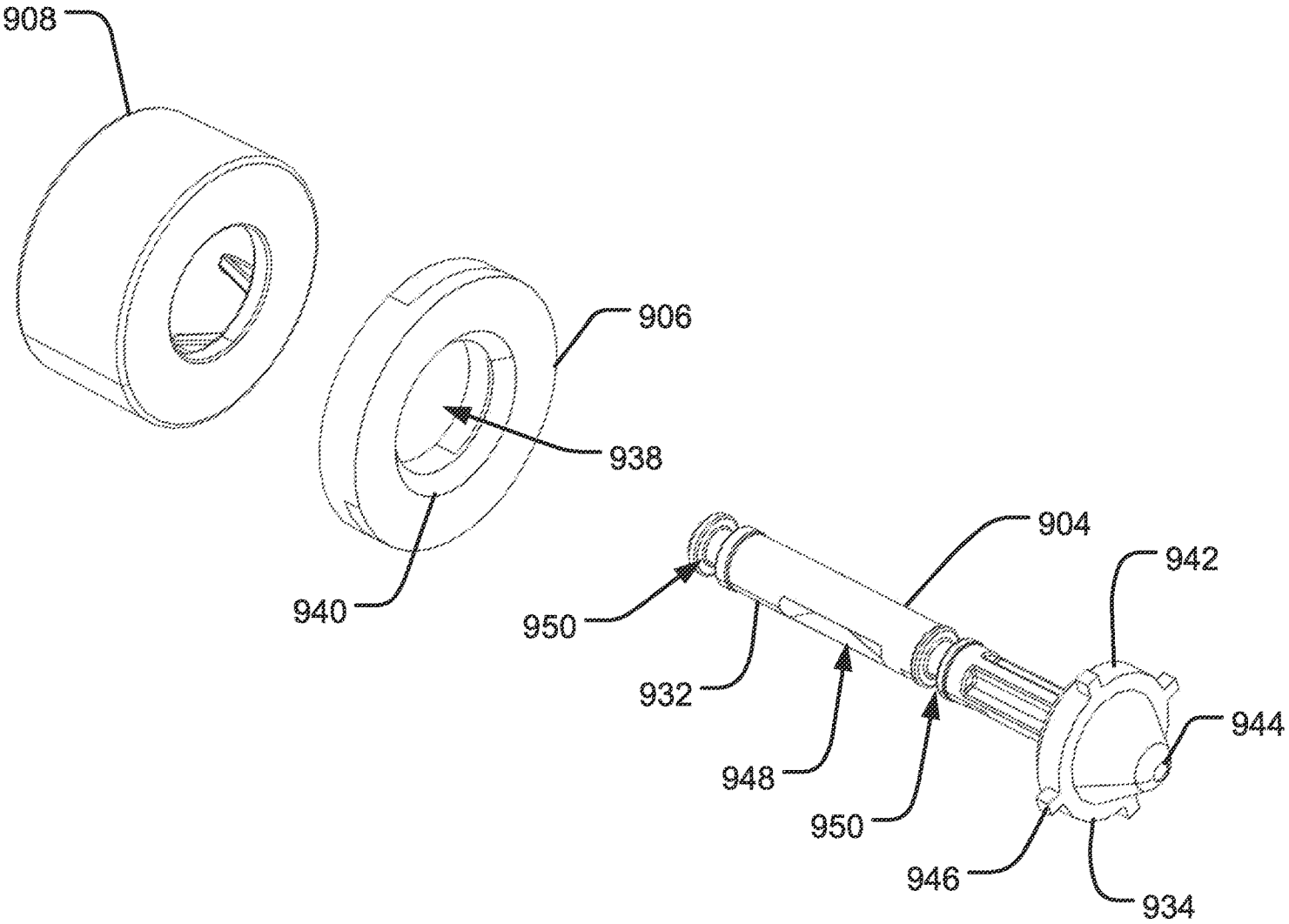
FIG. 11 is an exploded perspective view of a plunger, a washer, and an internal compartment of the spout diverter shown in FIG. 10.

FIG. 9 is a perspective view of another example of a spout assembly 900. FIG. 10 is a cross-sectional side view of the spout assembly 900 showing a third embodiment of a spout diverter 902 shown in an open position. FIG. 11 is an exploded perspective view of a plunger 904, a washer 906, and an internal compartment 908 of the spout diverter 902. Referring concurrently to FIGS. 9-12, the spout assembly 900 and the spout diverter 902 can share similar components with the examples described above. The spout diverter 902 is at least partially housed inside a spout housing 910. In other aspects, the spout diverters 300, 600 described above may be incorporated into the spout housing 910. In yet other aspects, the spout diverter 902 may be incorporated into the spout housing 102 (shown in FIG. 1) as required or desired.

The spout housing 910 includes a proximal end 912, a distal end 914, and a central axis 916 that extends along a length of the spout housing 910. An outlet 918 is located at the distal end 914 of the spout housing 910. The spout assembly 900 may also include a flow conversion component 920. In this example, the spout housing 910 may be substantially cylindrical in shape and elongated with the distal end 914 and the outlet 918 turned downward. The spout diverter 902 includes an actuator 922 that extends into the spout housing 910 and is configured to be pushed by a user and, similar to the operation as described above, divert water flow from the outlet 918 to another outlet (e.g., a shower head, not shown).

The spout diverter 902 is disposed at least partially within an interior cavity 924 of the spout housing 910 and includes the plunger 904, an adapter 928, the internal compartment 908, and a diverter housing 930. The actuator 922 engages with a stem 932 of the plunger 904 so that movement of the actuator 922 (e.g., from being pushed by a user) translates into sliding movement of the plunger 904 along the central axis 916. Both the actuator 922 and the stem 932 are slidingly supported by the diverter housing 930. The adapter 928 is configured to connect the spout assembly 900 to a water conduit (e.g., a pipe). At least a portion of the diverter housing 930 engages with the adapter 928 and the internal compartment 908 and the washer 906 are disposed therebetween. The stem 932 of the plunger 904 extends through the internal compartment 908 and the washer 906, and the plunger 904 includes a valve member 934 configured to sealingly engage with the washer 906 and close the spout diverter 902. The plunger 904 is biased via a spring 936. The spring 936 generates a biasing force that is configured to automatically return the spout diverter 902 towards the open position when water flow through the spout assembly 900 is stopped. Additionally, the spring 936 has a biasing force that is strong enough to withstand water pressure flowing around the plunger 904 when in the open position.

In this example, the washer 906 has a central aperture 938 that the stem 932 of the plunger 904 extends through. The upstream edge of the aperture 938 has a chamfer 940. In an aspect, the washer 906 is formed from a rubber material that can at least partially deform when sealed by the plunger 904. The valve member 934 of the plunger 904 includes a disc 942 and a nose 944 extending upstream thereof. The nose 944 is substantially conical is shape to promote water flow around the valve member 934 and through the spout diverter 902. The disc 942 extends radially outward from the stem 932 and the downstream side of the disc 942 includes a corresponding chamfer that is configured to sealing engage with the upstream side of the washer 906 and close the spout diverter 902. A circumferential surface of the disc 942 includes one or more tabs 946 radially extending therefrom. The tabs 946 are also configured to selectively engage with the washer 906. The tabs 946 are configured to reduce frictional engagement between the plunger 904 and the washer 906 so that the spout diverter 902 can more easily automatically reset without the plunger 904 being stuck within the washer 906.

As shown in FIG. 11, there are four tabs 946 circumferentially spaced around the disc 942. In an aspect, the tabs 946 are spaced approximately 90° apart from each other. It should be appreciated, that the number and spacing of the tabs 946 can be adjusted as required or desired while still enabling operation of the plunger 904 as described herein. The tabs 946 are also sized and shaped to keep water flow through the spout diverter 902 when opened. The tabs 946 are positioned radially outside of the chamfered surfaces so as to reduce the plunger 904 from at least partially sliding through the aperture 938 of the washer 906. Also shown in FIG. 11, the stem 932 includes an opening 948 having a slanted surface that engages with the actuator 922. On both sides of the opening 948, the stem 932 includes annular channels 950 configured to receive an O-ring or a Y-ring so as to sliding engage with and seal relative to the diverter housing 930. By supporting the sealing members on the stem 932 manufacturing efficiencies are increased. In an aspect, one or two sealing members may be used as required or desired.

Turning back to FIG. 10, an axial length of the adapter 928 is extended when compared to the above examples so that the chamber that the plunger 904 is disposed within increases in size. By increasing the length of the adapter 928 water flow through the spout diverter 902 is increased. In the example, the spout diverter 902 has a plurality of axial cross-sections that define a flow opening for water to flow through during operation (e.g., similar to the cross-sectional views in FIGS. 5 and 8). So as to reduce backflow and pressure generated by the spout diverter 902 (e.g., resulting in water flowing out of the spout assembly 900 and towards the remote outlet), the flow openings have a minimum cross-sectional area at every axial cross-section of the spout diverter 902. In an aspect, the minimum cross-section area of the flow openings of the spout diverter 902 is 0.2 square inches.

Figure 12:
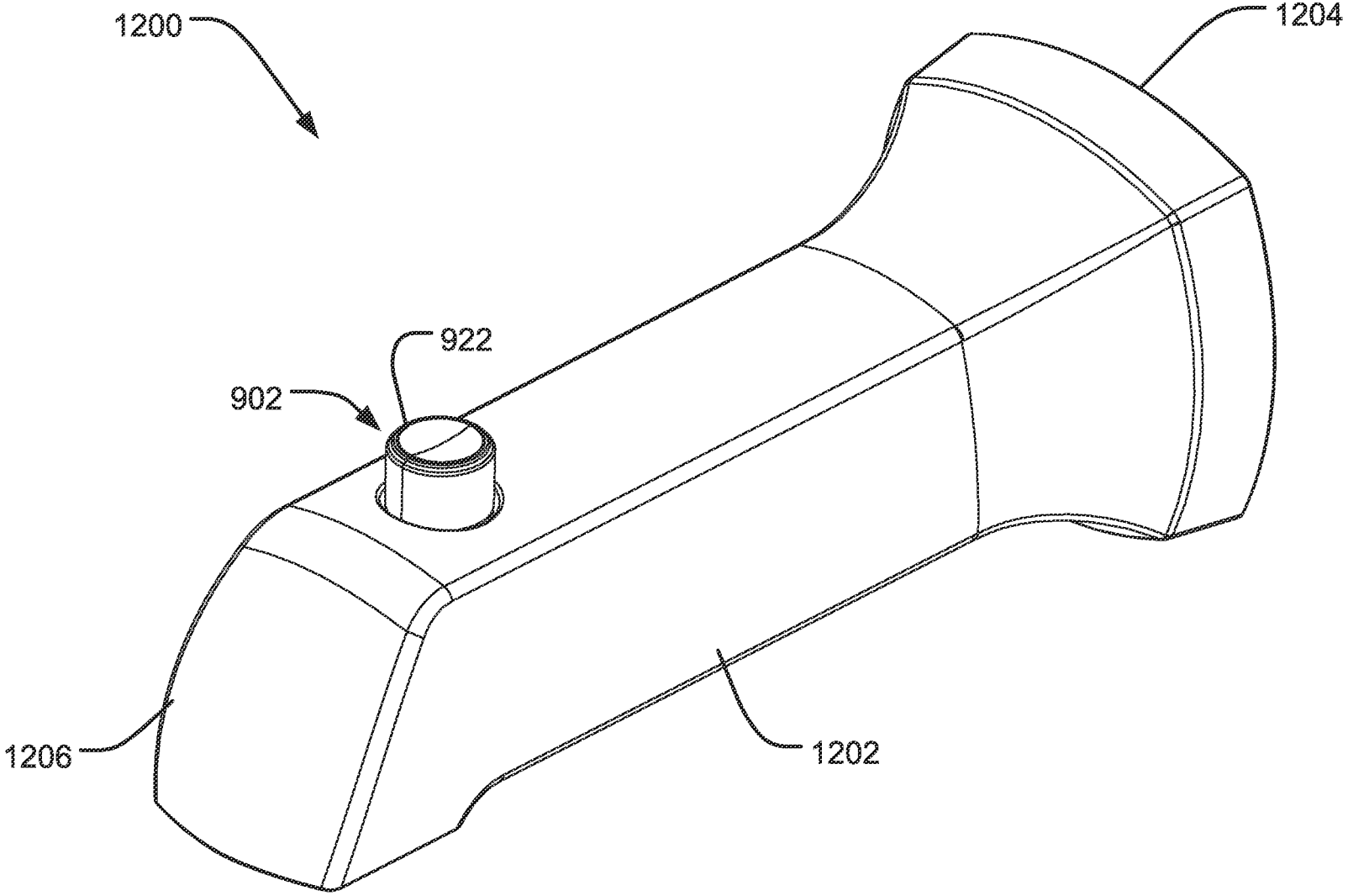
FIG. 12 is a perspective view of another example of a spout assembly according to the present disclosure.
Figure 13:
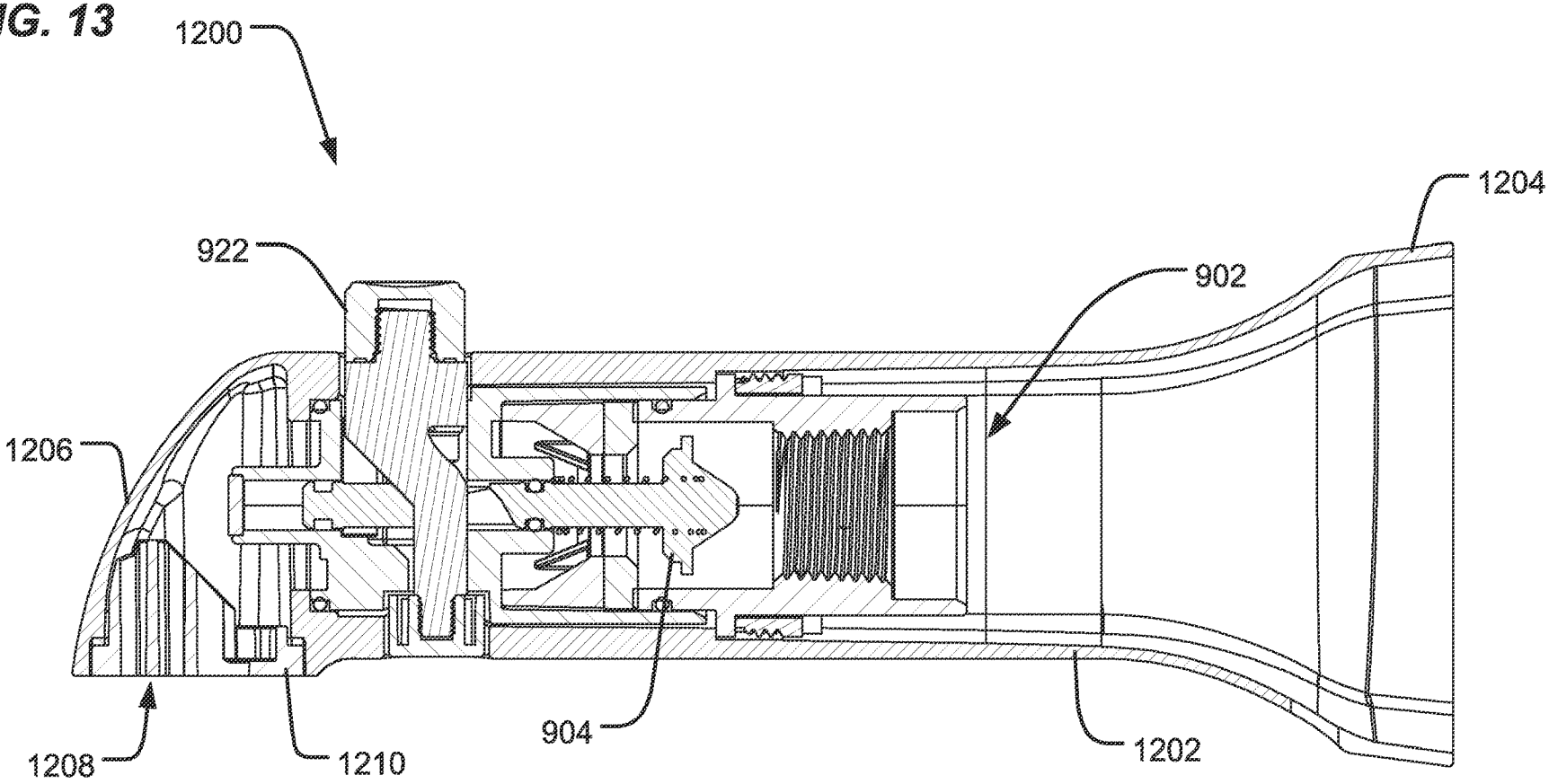
FIG. 13 is a cross-sectional side view of the spout assembly of FIG. 12 showing the third embodiment of the spout diverter shown in FIG. 10.

FIG. 12 is a perspective view of another example of a spout assembly 1200 according to the present disclosure. FIG. 13 is a cross-sectional side view of the spout assembly 1200 showing the third embodiment of the spout diverter 902. Referring concurrently to FIGS. 12-13, the spout diverter 902 is described above and is not necessarily described further. The spout diverter 902 is at least partially housed inside a spout housing 1202. In other aspects, the spout diverters 300, 600 described above may be incorporated into the spout housing 1202 as required or desired.

The spout housing 1202 includes a proximal end 1204 and a distal end 1206. An outlet 1208 is located at the distal end 1206 of the spout housing 1202. The spout assembly 1200 may also include a flow conversion component 1210. In this example, the spout housing 1202 may be substantially rectangular in shape and elongated with the distal end 1206 and the outlet 1208 turned downward. The proximal end 1204 may include a decorative flange as required or desired. Additionally or alternatively, the spout housing 1202 can take on any size, shape, or style as required or desired, and that enables the spout diverter to be housed therein as described herein.

The various embodiments described above are provided by way of illustration only and should not be construed to be limiting in any way. Various modifications can be made to the embodiments described above without departing from the true spirit and scope of the disclosure.

The invention claimed is:

1. A spout diverter, comprising:

a diverter housing;

an actuator extending into the diverter housing;

a stem engaged by the actuator to slide longitudinally to block and divert a water flow when the actuator is pushed into the diverter housing, wherein the stem includes a plunger that seals an opening to block and divert the water flow, and wherein pressure from the water flow acts on the plunger to keep the plunger blocking the opening while the water flow remains turned on; and a spring configured to move the stem to unblock the opening after the water flow is turned off.

2. The spout diverter of claim 1, wherein when the actuator is pushed along a first axis, the stem slides along a second axis, and the second axis is orthogonal to the first axis.

3. The spout diverter of claim 2, wherein the spout diverter is partially housed inside a spout housing having a central axis extending along a length between proximal and distal ends, and the second axis is parallel to the central axis of the spout housing.

4. The spout diverter of claim 1, wherein the plunger is positioned on a rear end of the stem.

5. The spout diverter of claim 1, wherein the plunger is positioned on a front end of the stem.

6. The spout diverter of claim 1, wherein the plunger includes at least one radially extending tab.

7. The spout diverter of claim 1, wherein the diverter housing shields the actuator from the water flow.

8. The spout diverter of claim 1, wherein the actuator has a slanted surface that engages a corresponding slanted surface on the stem to convert a movement of the actuator in a first direction along a first axis into a longitudinal movement of the stem along a second axis, and wherein the second axis is orthogonal to the first axis.

9. A spout diverter, comprising:

a diverter housing;

an actuator extending into the diverter housing; and a stem engaged by the actuator to slide from a first longitudinal position to a second longitudinal position when the actuator is pushed into the diverter housing, the stem having a plunger on a rear end, the plunger configured to block a water flow from entering the diverter housing when the stem is moved by the actuator to the second longitudinal position.

10. The spout diverter of claim 9, wherein the stem longitudinally slides through the diverter housing along an axis parallel to a length of the diverter housing.

11. The spout diverter of claim 9, wherein the actuator has a slanted surface that engages a corresponding slanted surface on the stem to convert a movement of the actuator in a first direction along a first axis into a longitudinal movement of the stem along a second axis, and wherein the second axis is orthogonal to the first axis.

12. The spout diverter of claim 11, wherein the spout diverter is housed inside a spout housing having a central axis extending along a length between proximal and distal ends, and the second axis is parallel to the central axis of the spout housing.

13. The spout diverter of claim 9, further comprising a washer, wherein the plunger engages the washer to seal an opening of an internal compartment to block the water flow from entering into the diverter housing when the stem is in the second longitudinal position.

14. The spout diverter of claim 9, wherein the diverter housing shields the actuator from the water flow.

15. The spout diverter of claim 9, wherein pressure from the water flow acts on the plunger to keep the plunger blocking an opening while the water flow remains turned on.

16. The spout diverter of claim 15, further comprising a spring configured to move the stem to unblock the opening after the water flow is turned off.

17. The spout diverter of claim 9, wherein the diverter housing includes a stop preventing the actuator from being pushed beyond a predefined distance.

* * * * *